US006872283B2

(12) United States Patent
Best

(10) Patent No.: US 6,872,283 B2
(45) Date of Patent: Mar. 29, 2005

(54) PAPER MACHINE CLOTHING AND A METHOD OF PRODUCING THE SAME

(75) Inventor: Walter Best, Duren (DE)

(73) Assignee: Heimbach GmbH & Co., Duren (DE)

( * ) Notice: Subject to any disclaimer, the term of this patent is extended or adjusted under 35 U.S.C. 154(b) by 5 days.

(21) Appl. No.: 10/423,024

(22) Filed: Apr. 25, 2003

(65) Prior Publication Data

US 2004/0005833 A1 Jan. 8, 2004

(30) Foreign Application Priority Data

Apr. 25, 2002 (EP) ..... 02009511

(51) Int. Cl.[7] ..... D21F 7/08; D21F 7/12; D03D 3/12

(52) U.S. Cl. ..... 162/358.2; 162/900; 428/114; 428/131; 428/190; 428/193; 428/218; 428/220; 428/223; 156/92; 156/181; 34/523

(58) Field of Search ..... 34/523, 115–123; 442/218, 220, 149–151, 263; 162/306, 348, 358.2, 358.4, 900–904; 28/110, 142; 139/383 A, 425 A; 428/105–114, 131–133, 190, 192–193, 223, 343–354; 156/148, 91, 92, 180, 181

(56) References Cited

U.S. PATENT DOCUMENTS

| | | | | | |
|---|---|---|---|---|---|
| 3,097,413 | A | | 7/1963 | Draper, Jr. | |
| 3,164,514 | A | * | 1/1965 | Day | 245/2 |
| 3,313,645 | A | * | 4/1967 | Wagner et al. | 428/360 |
| 3,867,766 | A | * | 2/1975 | Wagner | 34/95 |
| 4,142,557 | A | * | 3/1979 | Kositzke | 139/425 A |
| 4,196,248 | A | * | 4/1980 | Dutt | 442/60 |
| 4,550,440 | A | | 10/1985 | Rico | |
| 4,731,281 | A | * | 3/1988 | Fleischer et al. | 428/196 |
| 5,077,116 | A | * | 12/1991 | Lefkowitz | 428/141 |
| 5,628,876 | A | * | 5/1997 | Ayers et al. | 162/358.2 |
| 5,888,915 | A | * | 3/1999 | Denton et al. | 442/200 |
| 6,162,518 | A | | 12/2000 | Korfer | |
| 6,174,825 | B1 | * | 1/2001 | Dutt | 442/43 |
| 6,283,165 | B1 | | 9/2001 | Best | |
| 6,576,091 | B1 | * | 6/2003 | Cabell et al. | 162/348 |
| 2002/0102894 | A1 | | 8/2002 | Hansen | |

FOREIGN PATENT DOCUMENTS

| | | | | |
|---|---|---|---|---|
| DE | 1802560 | | 10/1968 | |
| EP | 0130106 | | 1/1985 | |
| EP | 0394293 | B1 | 5/1994 | |
| EP | 0922806 | | 6/1999 | |
| FR | 1571179 | | 6/1969 | |
| GB | 1058616 | * | 2/1967 | D21G/1/10 |
| WO | WO 99/64670 | | 12/1999 | |

* cited by examiner

*Primary Examiner*—Peter Chin
*Assistant Examiner*—Eric Hug
(74) *Attorney, Agent, or Firm*—Liniak, Berenato & White, LLC

(57) ABSTRACT

This invention relates to porous paper machine clothing (1, 11) for dewatering a paper web in a paper machine, comprising a filament lay-up made of at least one layer (2, 12) of longitudinal filaments (3, 13) and at least one layer (4, 14) of transverse filaments (5, 6, 7; 15) which cross the longitudinal filaments (3, 13), wherein the longitudinal and transverse filaments (3, 13; 5, 6, 7; 15) are adhesively bonded to each other via an adhesive at crossing points (8, 16). The invention further relates to a method of producing porous paper machine clothing such as this.

30 Claims, 4 Drawing Sheets

PAPER MACHINE CLOTHING AND A METHOD OF PRODUCING THE SAME

FIELD OF THE INVENTION

This invention relates to porous paper machine clothing for dewatering a paper web in a paper machine, particularly as a paper machine felt or drying screen, comprising a filament lay-up made of at least one layer of longitudinal filaments and at least one layer of transverse filaments which cross the longitudinal filaments, wherein the longitudinal and transverse filaments are adhesively bonded to each other via an adhesive in the region of crossing points. The invention further relates to a method of producing porous paper machine clothing, wherein a filament lay-up is produced by arranging at least one layer of longitudinal filaments and at least one layer of transverse filaments, which cross the longitudinal filaments, one above the other, and joining the longitudinal and transverse filaments to each other using adhesive in the region of crossing points.

BACKGROUND OF THE INVENTION

Porous paper machine clothing comprises long, wide belts which circulate in different parts of a paper machine and on which the paper web is conveyed through the paper machine. In the first part, which is termed the sheet forming section, a fibrous pulp is deposited on the paper machine clothing, whereupon a web of fibrous material is formed. This is dewatered through the paper machine clothing. The paper machine clothing consists of a textile filament product which is sufficiently porous for the liquid which originates from the web of fibrous material to be conveyed away through the paper machine clothing as a result of the effect of gravity and reduced pressure. In the subsequent press section, the paper web and the paper machine clothing are passed through roll presses so that the liquid which still remains in the paper web is pressed out through the paper machine clothing. In general, the paper machine clothing is formed as a felt comprising a support made of a textile filament product. In the subsequent drying section, the paper web and the paper machine clothing are passed over heated rolls, whereby further dewatering occurs—which is more precisely termed drying in this case. In the drying section, paper machine clothing which consists of filament-containing products is mainly used, i.e. as a drying screen, which is also porous, in order to convey the vapour away via the pores.

These textile filament products are mainly formed as woven fabrics. In addition, what are termed filament lay-ups are also known, in which the filaments are not bound to each other, i.e. they are not woven to or meshed with each other. U.S. Pat. No. 3,097,413 A discloses paper machine clothing such as this. It has a filament lay-up comprising a layer of longitudinal filaments which extend parallel to and at a distance from each other, and which are not joined to each other. A fibrous felt, which surrounds the longitudinal filaments and which is needle-bonded thereto, is applied to this layer.

Paper machine clothing such as this only has a low transverse strength, however. A change has therefore been made to the use of a combination of a layer of longitudinal filaments with a layer of transverse filaments (DE 1 802 560 A; EP 0 394 293 B). In this procedure, modules consisting of a fibrous layer and of a fibrous web needle-bonded thereto are first formed, and these modules are combined and are needle-bonded again. This manner of production is not suitable for paper machine clothing which consists of one filament product only. In this situation, U.S. Pat. No. 4,555,440 A proposes that the individual fibrous layers be joined to each other by binding filaments.

In particular, in the aforementioned paper machine clothing of this type, the resistance to displacement between the individual layers, and thus the dimensional stability, is unsatisfactory. If binding filaments are used, they constitute extraneous bodies and significantly complicate the manufacturing process. In order to eliminate these disadvantages, U.S. Pat. No. 5,888,915 A proposes that the layers of longitudinal and transverse filaments are laid directly on each other and are fused to each other by heating at their crossing points. The pre-requisite for this, however, is that two-component filaments are used in which the filament core has a higher melting temperature than the filament cladding. Fusion occurs by heating to a temperature above the melting point of the filament cladding and below the melting point of the filament core.

Due to the direct bonding of the filaments of the individual layers, the dimensional stability of the paper machine clothing is improved. One disadvantage, however, is that special filaments, namely two-component filaments, have to be used. These are expensive, and their material properties cannot always be adjusted in the optimum manner to suit the conditions in the respective part of the paper machine.

FR 1 571 179 A discloses paper machine clothing of this type which comprises a filament lay-up which consists of a layer of longitudinal filaments and two layers of transverse filaments which surround said layer. In order to join the longitudinal filaments to the transverse filaments, all three layers are firstly placed one above another. Thereafter, continuous strands of adhesive, which are bonded to the longitudinal filaments between the transverse filaments and which extend beyond the transverse filaments, are applied to both sides of the longitudinal filaments.

This type of adhesive bonding between the layers of the filament lay-up of the paper machine clothing has considerable disadvantages. Thus, considerable amounts of adhesive are necessary in order to produce strands of adhesive along all the longitudinal filaments, and moreover a relatively thick application of adhesive is necessary in order to produce the bond. Furthermore, the strength of the bond in the region of the crossing points is unsatisfactory, i.e. the strength of the filament lay-up is not particularly high. In addition, the strands of adhesive are completely exposed and the surfaces thereof are therefore subject to the risk of being converted to into a slightly tacky state under the prevailing conditions of humidity and temperature in the paper machine. Contaminant particles or fibres are then deposited thereon, i.e. the filament lay-up is contaminated. Adhering particles of contaminants can even result in an impairment of the quality of the paper web.

SUMMARY OF THE INVENTION

The underlying object of the present invention is therefore to effect joining of the longitudinal and transverse filaments in paper machine clothing of the type cited at the outset so that the consumption of material which is necessary therefor is significantly reduced, the strength is improved, and the risk of contamination is considerably reduced.

A second object consists of providing a method of producing the same.

The first object is achieved according to the invention in that the adhesive is disposed between the mutually opposite faces of the longitudinal and transverse filaments and joins said faces. The basic concept of the invention is therefore to join the mutually opposite faces of the longitudinal and transverse filaments at their crossing points via the adhesive. In this manner, the application of adhesive can be limited to these faces, whereby comparatively small amounts of adhesive are necessary. Moreover, there is no risk of contaminating the filament lay-up and thus of damaging the paper web. In addition, the joining of the mutually opposite faces by an adhesive improves the strength of the joints and thus of the filament lay-up as a whole.

Particularly suitable adhesives comprise hot-melt adhesives, the melting temperature of which is below that of the filaments, diffusion adhesives, contact adhesives and/or reaction adhesives.

In one embodiment of the invention, the longitudinal and transverse filaments are additionally positively attached to each other at crossing points, wherein each joint consists of an aperture in one filament and of a projection, which fits suitably therein, on the crossing filament, or of apertures which are mutually aligned at the crossing points and of pins which pass through said apertures, which may consist of bolts or rivets made of plastics or metal, for example. A positive attachment such as this assists the adhesive joint and imparts even more strength.

It is particularly preferred if the longitudinal and transverse filaments are formed as flat filaments with a rectangular cross-section. In this manner, surface contact occurs at the crossing points, and the area over which the filaments are adhesively bonded to each other is considerably enlarged and is thus stronger. A range from 2 to 20 mm, preferably from 8 to 12 mm, has proved to be an advantageous width for the longitudinal and transverse filaments. The thickness should range between 0.3 and 2 mm, preferably between 0.6 and 1.2 mm, wherein the transverse filaments should have a thickness which as a maximum is the same as that of the longitudinal filaments.

In order to ensure sufficient permeability to water or vapour, particularly for very wide, flat filaments, passageway openings can be provided in the longitudinal and/or transverse filaments. The permeability can be controlled as desired by the size and number of the passageway openings, and it is also possible to arrange for the permeability to be different over the width of the paper machine clothing, e.g. for it to be higher in the middle than in the edge regions or vice versa. The passageway openings can be formed as round holes or as elongated slits.

The paper machine clothing according to the invention may comprise any number of layers, wherein each layer comprising longitudinal filaments alternates with a layer comprising transverse filaments, i.e. said layers are each adjacent to each other. An advantageous number of layers is two or three layers, wherein in the former case a lower longitudinal filament lay-up is preferably combined with an upper transverse filament lay-up, and in the latter case each layer comprising transverse filaments is surrounded on both sides by a layer of longitudinal filaments. In this manner, a longitudinal structure is formed on the upper and lower sides. It is also possible, of course, to employ the converse procedure, so that a transverse structure exists on the upper and lower sides due to the transverse filaments which are present there.

The permeability of the paper machine clothing can also be adjusted within wide limits by the width dimensions of the longitudinal and/or transverse filaments and/or by the filament density thereof, for example. It is also possible for the longitudinal filaments to be disposed in at least one layer so that in the middle region they have a filament density which is different from that in the edge regions, and so that in particular they have a density in the middle region which is less than that in the edge regions.

With the filament lay-up according to the invention, eyelets can also be formed in a simple manner on the end faces of the paper machine clothing by wrapping round longitudinal filaments with the formation of loops, in order to form an inserted wire joint therewith. This can be effected by wrapping the end pieces of longitudinal filaments of a first layer round the end faces of the paper machine clothing with the formation of loops on the side, which is remote from said layer, of the layer comprising transverse filaments, and fixing them to a plurality of said transverse filaments, preferably to at least five transverse filaments. The end pieces can also be fixed to the longitudinal filaments themselves, however. In both cases, fixation can be effected positively, e.g. by means of pins or rivets made of plastics or metal.

Loop formation should advantageously be affected only with part of the longitudinal filaments, so that the loops of the two end edges fit into each other in the manner of combs and can thus form a passageway channel for an inserted wire. In an alternating manner, at least one end piece should preferably be looped round with the formation of a loop, and at least one end piece should end at the respective outer transverse filament without the formation of a loop. So that the permeability in this region is not impaired, longitudinal filaments from a second layer, which is seated against the layer comprising transverse filaments, should adjoin the ends of the end pieces, i.e. these longitudinal filaments should abut the end pieces flush therewith, but should not overlap them, so that there is no densification of longitudinal filaments in this region.

In principle, there are no limitations with regard to the material of the filaments; they should have a high tensile strength, a low elongation and a high initial modulus. Examples of suitable materials include PET, PA in all modifications, PPS, PEK, PEEK, elastic polyesters, PBT or PTT or combinations thereof. The filaments can be reinforced, e.g. fibre-reinforced with glass fibres, carbon fibres and/or ceramic fibres, wherein the fibres can also be present as short chopped fibres.

The paper machine clothing according to the invention can be used in all parts of a paper machine, and due to its flexibility can be adapted in the optimum manner to the respective requirements in these parts. Constructions in which the paper machine clothing consists of a filament lay-up are particularly suitable for use in the sheet forming and drying sections. This does not rule out the combination of a filament lay-up with other components, for example with a fibrous felt. For the press section, it is recommended that the filament lay-up according to the invention is used as a support and is provided on one or both sides with a fibrous layer, for example by the needle-bonding or laminating of fibrous felts or spun felts to one or both sides, for example.

In order to produce the paper machine clothing described above, a method is proposed according to the invention in which the adhesive is disposed between the mutually opposite faces of the longitudinal and transverse filaments for the purpose of joining said faces.

According to a further feature of the invention, provision is made for the longitudinal and transverse filaments to be additionally positively attached to each other at crossing points, e.g. by the interlocking of a projection on one filament with a complementary aperture on the crossing filament, or by means of inserting a pin, such as a bolt or rivet, in aligned apertures in the filaments. The joint at the crossing points is thereby further strengthened.

In detail, the filament lay-up can be produced by firstly clamping longitudinal filaments parallel to each other, for example between two parallel filament beams, and then laying transverse filaments, individually or in groups, successively on said longitudinal filaments and adhesively bonding longitudinal and transverse filaments to each other at the crossing points, wherein a positive joint can be produced in addition by pushing connecting pins into holes which are aligned at the crossing points, or by pushing a projection on one filament into a complementary aperture in the other filament.

If a felt is to be formed, for example for use in the press section of a paper machine, a fibrous layer should be applied to one or both sides of the filament lay-up and fixed thereto. Fixing can be effected by means of needle-bonding, adhesive bonding, or contact fusion.

It should be understood that the transverse filaments do not have to extend perpendicularly to the longitudinal filaments, but that filament lay-ups can also be produced by the method according to the invention in which the transverse filaments extend obliquely to the longitudinal filaments. At the same time, two layers of transverse filaments can also be provided in which the transverse filaments of one layer cross the longitudinal filaments at a different angle to that of the other layer.

DESCRIPTION OF THE DRAWINGS

The invention is illustrated in more detail, with reference to examples of embodiments, in the drawings, where.

DETAILED DESCRIPTION OF THE PREFERED EMBODIMENTS

Figures 1, 2, 3:
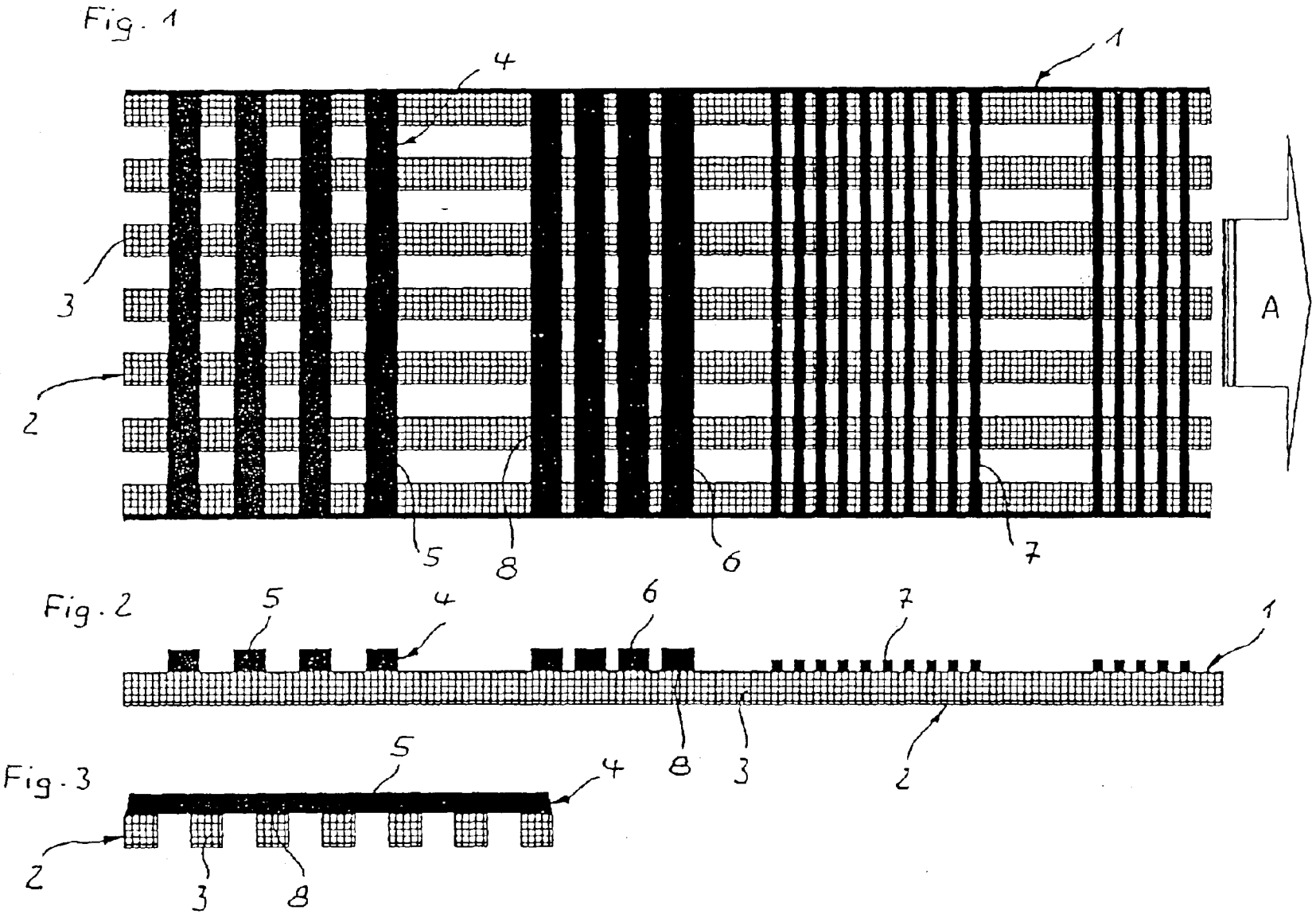
FIG. 1 is a schematic plan view of the paper machine clothing.
FIG. 2 is a side view of the paper machine clothing shown in FIG. 1.
FIG. 3 is a cross-section through the paper machine clothing shown in FIGS. 1 and 2.
Figure 4:
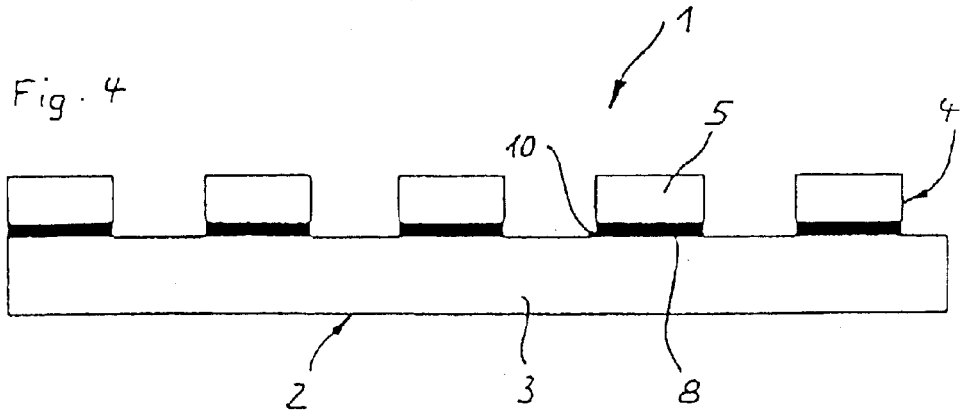
FIG. 4 is an enlarged side view of the paper machine clothing shown in FIGS. 1 to 3.

The paper machine clothing 1 illustrated in FIGS. 1 to 4 consists of a filament lay-up, the lower layer 2 of which is formed by longitudinal filaments—denoted by 3, for example. As can be seen in particular from FIG. 3, the longitudinal filaments 3 have a rectangular cross-section and are at identical spacings from each other. For the production process, the left-hand ends of the longitudinal filaments are wound on a filament beam, which is not shown here. A second beam, which is likewise not shown here, but on which the finished paper machine clothing 1 is wound up, is provided on the right-hand side. The paper machine clothing 1 is moved in this direction (arrow A).

An upper layer 4 comprising mutually parallel transverse filaments—denoted by 5, 6, 7, for example—is laid on the lower layer 2. The transverse filaments 5 are disposed at a wide spacing which substantially corresponds to the spacing between the longitudinal filaments 3, whilst the transverse filaments 6 are disposed at a narrow spacing for the purpose of reducing the permeability of the paper machine clothing 1, and the transverse filaments 7 are likewise disposed at a narrow spacing but have a width which is substantially less than that of the transverse filaments 5, 6. It should be understood that these differences are not present on actual paper machine clothing, i.e. identical transverse filaments are used at identical spacings from each other. The object of the illustration in the form shown here is to emphasise that the method according to the invention enables very different types of longitudinal and transverse filaments 3, 5, 6, 7 and filament densities to be employed. The same applies to the longitudinal filaments 3, wherein it is also possible here for the spacings thereof to be varied over the width thereof, e.g. to provide a filament density in the middle region which is less than that in the two end regions, or vice versa. Similarly, the longitudinal filaments may have a width in their middle region which differs from the width in the filaments' edge regions.

In order to produce the paper machine clothing 1 the longitudinal filaments 3 are clamped between the two beams, and the transverse filaments 5, 6, 7 are then laid over the longitudinal filaments 3. This can be effected by machine, using a transverse table apparatus such as that which is known in principle from U.S. Pat. No. 3,097,413 for example. In order to join the transverse filaments 5, 6, 7 to the longitudinal filaments 3, they are adhesively bonded to each other at their crossing points—denoted by 8, for example—by a layer of adhesive—denoted by 10, for example. The adhesive can be applied to the longitudinal and/or transverse filaments 3, 5, 6, 7 as spots or two-dimensionally, dimensionally, wherein in the latter case it should be possible subsequently to remove the adhesive, for example with the aid of a solvent which is applied to the finished paper machine clothing. In addition, a plate can be laid on the upper layer 4, e.g. a glass plate which presses the transverse filaments 5, 6, 7 on to the longitudinal filaments 3 and thus prevents displacement between the two until the adhesive bond has become solid.

Figure 5:
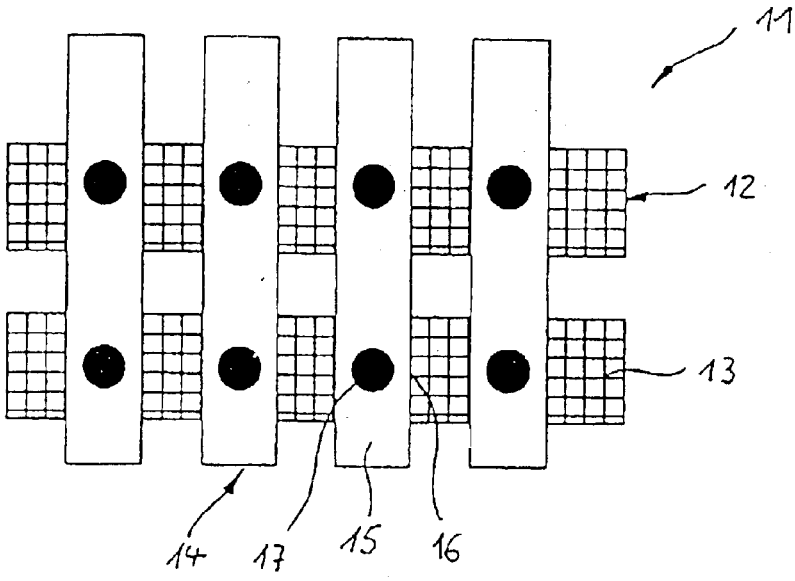
FIG. 5 is a plan view of part of the paper machine clothing with additional positive attachment of the filaments.
Figure 6:
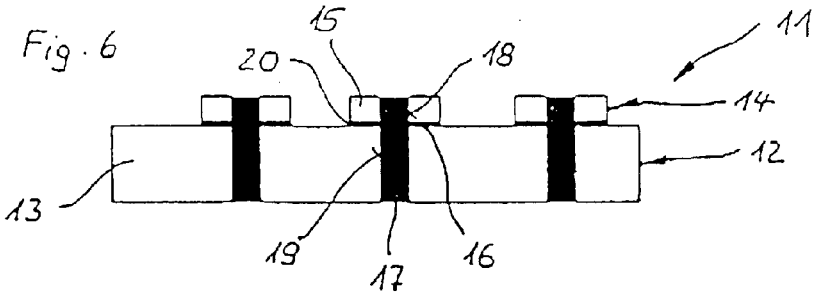
FIG. 6 is a partial cross-section through the paper machine clothing shown in FIG. 5.

FIGS. 5 and 6 show portions of a different paper machine clothing 11 comprising a lower layer 12 made of longitudinal filaments—denoted by 13 for example—and an upper layer 14 made of transverse filaments—denoted by 15 for example. It should be understood that a multiplicity of a longitudinal filaments 13 is present, and that the transverse filaments 15 extend over the entire width of the paper machine clothing 11.

The longitudinal and transverse filaments 13, 15 likewise have a rectangular cross-section here, wherein the transverse filaments 15 are flatter than the longitudinal filaments 13. At their crossing points—denoted by 16, for example—the longitudinal and transverse filaments 13, 15 are positively joined to each other via connecting pins—denoted by 17, for example—which each pass through mutually aligned holes—denoted by 18, 19, for example—in the longitudinal and transverse filaments 13, 15. Instead of this, however, the connecting pins 17 can also be integrally formed on the longitudinal filaments 13 or on the transverse filaments 15, so that only the respective other filaments comprise holes into which the connecting pins 17 are then pushed.

The positive joint ensures additional fixing of the longitudinal and transverse filaments 13, 15 at their crossing points 16, and assists the joint which is formed by means of layers of adhesive—denoted by 20, for example.

Figure 7:
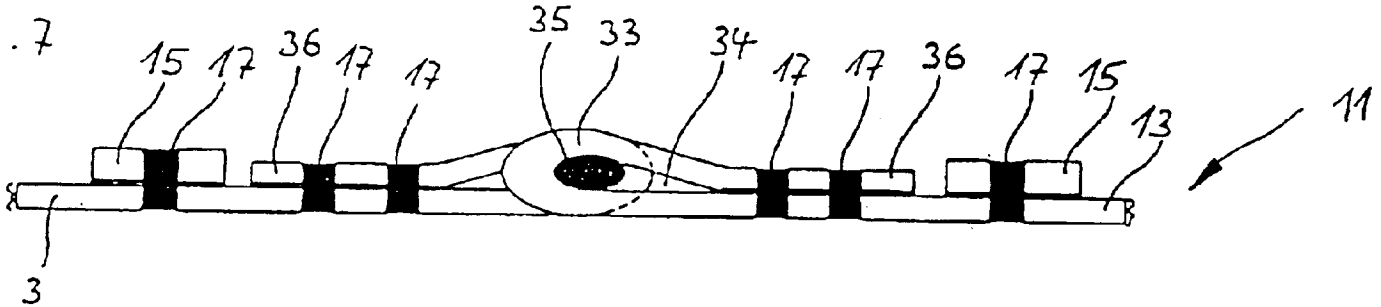
FIG. 7 is a side view of the seam region of the paper machine clothing according to FIGS. 1 through 3.
Figure 8:
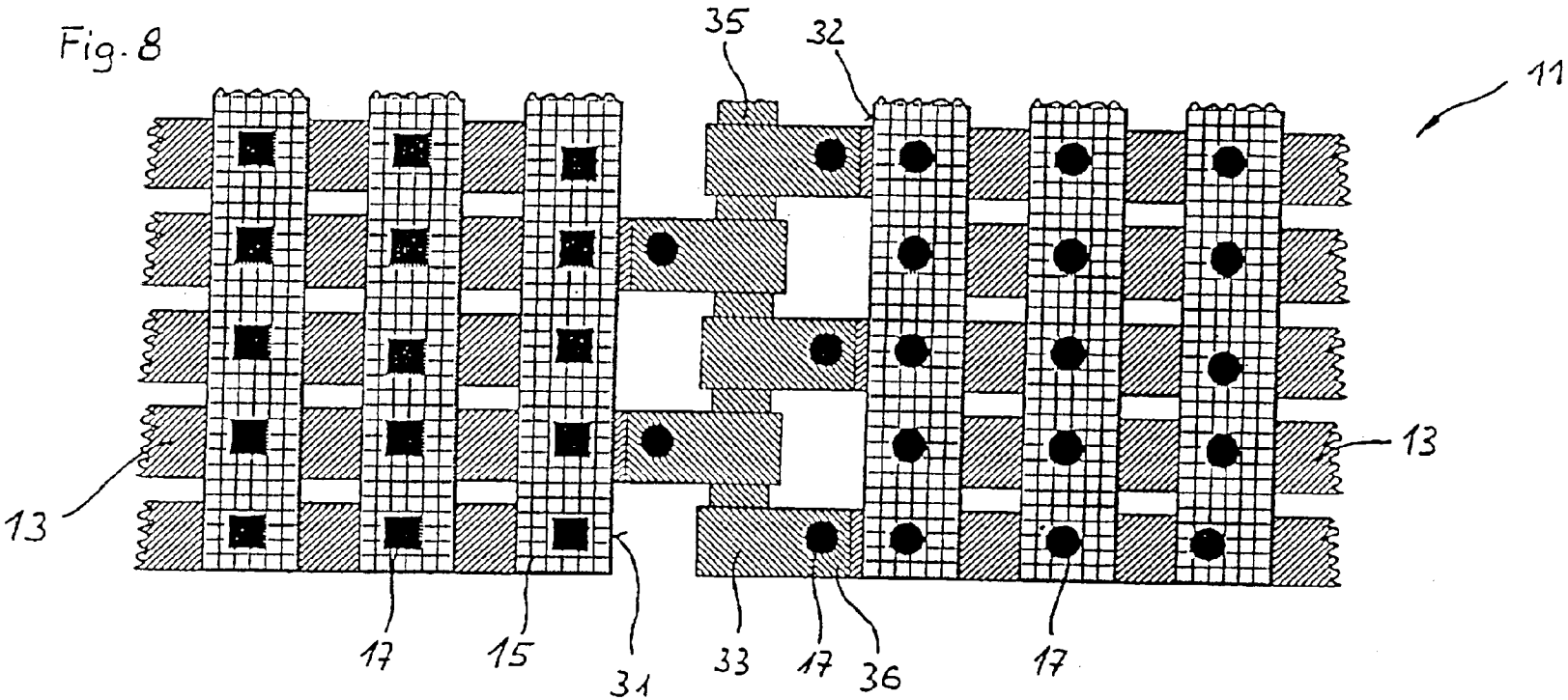
FIG. 8 is a plan view of the seam region of the paper machine clothing according to FIGS. 1 through 3.

In FIGS. 7 and 8, the end regions of paper machine clothing 11 are depicted partially, i.e. reduced in width to five longitudinal yarns 13. Transverse yarns 15 are connected via connecting studs 17 to longitudinal yarns 13; on the left side, connecting studs 17 that are square in cross section were used, and on the right side connecting studs 17 that are round in cross section. This depiction is provided solely in order to demonstrate that different cross sections can be used for connecting studs 17. Connecting studs 10 that all have the same cross-sectional shape will usually be used in a paper machine clothing 1.

At both ends 31, 32 of paper machine clothing 11, every second longitudinal yarn 13 protrudes in such a way that longitudinal yarns 13 of the two ends 31, 32 engage into one another in comb fashion, i.e. wherever a longitudinal yarn 3 projects at the one end 31, that longitudinal yarn 13 does not project at the other end 32, so that a gap is created for the portion of longitudinal yarn 13 projecting at end 31. The projecting portions of longitudinal yarns 13 are looped over and back to form loops (labeled 33 by way of example). They thereby form loop openings (labeled 34 by way of example) that all align with one another and thereby form a conduit through which a coupling wire 35 is inserted. This coupling wire 35 connects ends 31, 32 of paper machine 1, thus yielding an endless paper machine clothing 11. Paper machine clothing 11 can be opened again by pulling out coupling wire 35, for example in order to pull paper machine clothing 11 into a paper machine or remove it therefrom.

As is evident in particular from FIG. 7, the turned-over loop ends (labeled 36 by way of example) are laid back down onto the associated longitudinal yarn 13 and joined to it via connecting studs 17 in the same way that transverse yarns 5 are joined to longitudinal yarns 13. FIG. 7 illustrates a connection of loop ends 36 using two connecting studs 17 in each case, but FIG. 8 illustrates the use of only one connecting stud 17. The variant according to FIG. 7 is suitable for transferring particularly large tensile forces.

Figures 9, 10, 11:
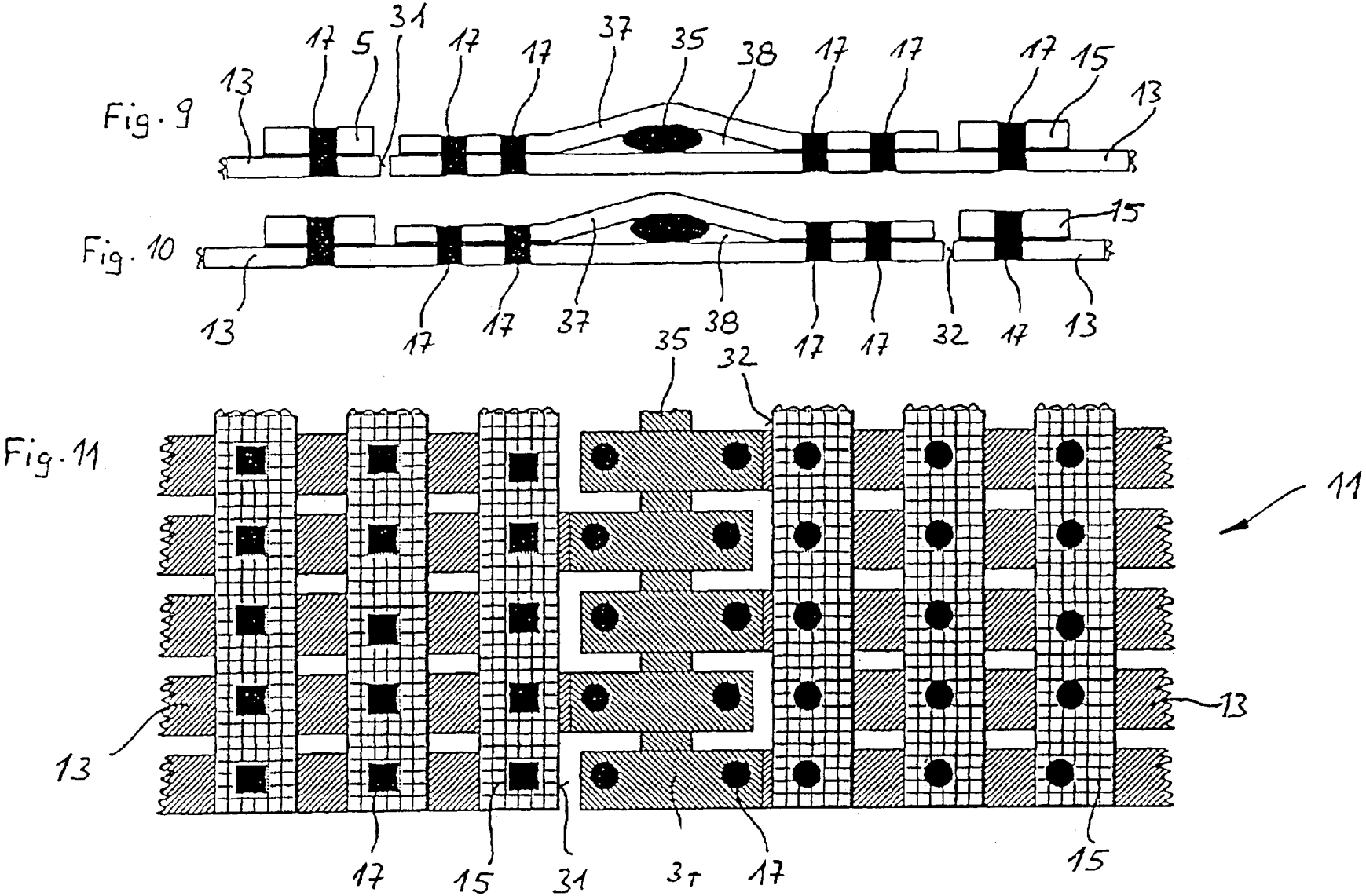
FIG. 9 is a longitudinal section through the seam region of the paper machine clothing according to FIGS. 1 through 3, showing the prolongation of a longitudinal yarn beyond the right end of the paper machine clothing.
FIG. 10 is a cross section through the seam region of the paper machine clothing according to FIGS. 1 through 3, showing the prolongation of a longitudinal yarn beyond the left end of the paper machine clothing according to FIGS. 1 through 3.
FIG. 11 is a plan view of the seam region of the paper machine clothing according to FIGS. 9 and 10.

In the exemplary embodiment according to FIGS. 9 through 11, paper machine clothing 11 has a form of connection of ends 31, 32 that differs from the embodiment according to FIGS. 7 and 8. Longitudinal yarns 13 are prolonged in the same way as in the embodiment according to FIGS. 7 and 8, i.e. they engage in comb fashion into one another. They are not, however, turned back to form loops; instead they extend out flat and end in the vicinity of transverse yarns 15 of the respective other end 31 or 32.

Yarn strips (labeled 37 by way of example) are laid onto the projecting portions of longitudinal yarns 13 in such a way that mutually alighning openings 38 are produced. Coupling wire 35 is inserted through these openings 38. On either side of coupling wire 35, yarn strips 37 are connected to the projecting portions of longitudinal yarns 13 by means of connecting studs 17. In the variant shown in FIGS. 9 and 10, four connecting studs 17—two on either side of coupling wire 35—are used for this in each case, so that large loads can be handled. If the loads are smaller, two connecting studs 17—one on either side of coupling wire 35—are sufficient in each case, as depicted in FIG. 11.

I claim:

1. Porous drying screen for a drying section of a paper machine, comprising a filament lay-up comprised of at least one layer (2, 12) of longitudinal filaments (3, 13) and at least one layer (4, 14) of transverse filaments (5, 6, 7; 15) which cross said longitudinal filaments (3, 13), wherein said longitudinal and transverse filaments (3, 13; 5, 6, 7; 15) are comprised of thermoplastic material and are adhesively bonded to each other by an adhesive at crossing points (8, 16) between said longitudinal and transverse filaments, characterised in that said longitudinal and transverse filaments are flat filaments and the adhesive is applied solely to mutually opposite faces of said longitudinal and transverse filaments (3, 13; 5, 6, 7; 15).

2. Porous drying screen according to claim 1, characterised in that the adhesive (10, 20) is one of a hot-melt adhesive, a diffusion adhesive, a contact adhesive or a reaction adhesive.

3. Porous drying screen according to claim 1, characterised in that said longitudinal and transverse filaments (3, 13; 5, 6, 7; 15) are additionally positively attached to each other at said crossing points (8, 16), said crossing points forming a joint.

4. Porous drying screen according to claim 3, characterised in that each said joint comprises an aperture in one of said longitudinal or said transvers filaments and of a projection extending from one of said longitudinal or said transverse filaments, said projection fitting suitably within said aperture.

5. Porous drying screen according to claim 3, characterised in that each said joint consists of mutually aligned apertures (18, 19) in said filaments (13, 15) and of a pin (17) which passes through said mutually aligned apertures.

6. Porous drying screen according to any claim 1, characterised in that said longitudinal and transverse filaments (3, 13; 5, 6, 7; 15) are formed as flat filaments with a rectangular cross-section.

7. Porous drying screen according to claim 6, characterised in that said longitudinal and transverse filaments (3, 13; 5, 6, 7; 15) have a width of 2 to 20 mm.

8. Porous drying screen according to claim 1, characterised in that said longitudinal filaments (3, 13) have a width in said longitudinal filaments' middle region which differs from that in said longitudinal filaments' edge regions.

9. Porous drying screen according to claim 6, characterised in that said longitudinal and transverse filaments (3, 13; 5, 6, 7; 15) have a height of 0.3 to 2 mm.

10. Porous drying screen according to claim 6, characterised in that said transverse filaments (5, 6, 7; 15) have a maximum thickness which is the same as that of the longitudinal filaments (3).

11. Porous drying screen according to claim 1, characterised in that said longitudinal and said transverse filaments comprises passageway openings.

12. Porous drying screen according to claim 1, characterised in that at least three layers are present, wherein a layer comprising said longitudinal filaments and a layer comprising said transverse filaments are adjacent.

13. Porous drying screen according to claim 12, characterised in that each said layer comprises said transverse filaments and is surrounded on both sides by a layer of said longitudinal filaments.

14. Porous drying screen according to claim 1, characterised in that at least one layer comprising said longitudinal filaments has a filament density in its middle region which differs from that in said longitudinal filament's edge regions.

15. Porous drying screen according to claim 1, characterised in that end pieces of said longitudinal filaments (3, 13) are wrapped round and fixed to end faces of said dryer screen with the formation of loops.

16. Porous drying screen according to claim 15, characterised in that said end pieces are fixed to said transverse filaments (5, 6, 7; 15) on a side, which is remote from a layer (2, 12) comprising said longitudinal filaments (3, 13), of the layer (4, 14) comprising said transverse filaments (5, 6, 7; 15).

17. Porous drying screen according to claim 15, characterised in that said end pieces are fixed to said longitudinal filaments (3, 13).

18. Porous drying screen according to claim 15, characterised in that non-loop-forming end pieces of said longitudinal filaments (3, 13) are each fixed to a last of said transverse filaments (5, 6, 7; 15) on said end face of said porous dryer screen.

19. Porous drying screen according to claim 15, characterised in that at least one said end piece is wrapped round with the formation of a loop, and at least one said end piece ends at an outer edge of the last said transverse filament (5, 6, 7; 15) on the end face of said porous dryer screen.

20. Porous drying screen according to claim 15, characterised in that said longitudinal filaments of a second layer comprising said longitudinal filaments, which is seated against the layer comprising said transverse filaments, adjoin the ends of the end pieces.

21. Porous drying screen according to claim 1, characterised in that said longitudinal and transverse filaments (3, 13; 5, 6, 7; 15) are comprised of PET, PA in all modifications, PPS, PEK, PEEK, an elastic polyester, PBT or PTT or a combination thereof.

22. Porous drying screen according to claim 1, characterised in that said longitudinal and transverse filaments (3, 13; 5, 6, 7; 15) are fibre-reinforced.

23. Porous drying screen according to claim 1, characterised in that a fibrous layer is provided on at least one side.

24. A method of producing porous dryer screens for a dryer section of a paper machine wherein a filament lay-up is produced by arranging at least one layer (2, 12) of longitudinal filaments (3, 13) and at least one layer (4, 14) of transverse filaments (5, 6, 7; 15), which cross the longitudinal filaments (3, 13), one above the other, and wherein the longitudinal and transverse filaments are comprised of thermoplastic material and joined to each other by adhesive at crossing points (8, 16) between the longitudinal and transverse filaments, characterised in that flat filaments are used for the longitudinal and transverse filaments and that the adhesive is disposed exclusively between mutually opposite faces of the longitudinal and transverse filaments (3, 13; 5, 6, 7; 15) for joining the faces.

25. A method according to claim 24, characterised in that the longitudinal and transverse filaments (3, 13; 5, 6, 7; 15) are additionally positively attached to each other at the crossing points (8, 16).

26. A method according to claim 24, characterised in that the longitudinal filaments (3, 13) are clamped parallel to each other, and that the transverse filaments (5, 6, 7; 15) are then laid, individually or in groups, successively on the longitudinal filaments (3, 13) and are fixed to a first side of the longitudinal filaments (3, 13), and that the filament lay-up is conveyed in a longitudinal direction and is then rolled up.

27. A method according to claim 26, characterised in that the transverse filaments (5, 6, 7; 15) are also fixed, one of simultaneously or later, to a second side of the longitudinal filaments (3, 13).

28. A method according to claim 26, characterised in that temporary fixing is effected by application of additional weight.

29. A method according to claim 24, characterised in that the layers (2, 12; 4, 14) are temporarily pressed on to each other at the crossing points (8, 16) for fixation.

30. A method according to claim 24, characterised in that a fibrous layer is applied to one or both sides of the filament lay-up and is fixed thereto.

* * * * *